US005417307A

United States Patent [19]

McIntyre et al.

[11] Patent Number: 5,417,307

[45] Date of Patent: May 23, 1995

[54] MULTI-PURPOSE WORKTABLE

[75] Inventors: Jonothon M. W. McIntyre, 6733 Hinds Ave., North Hollywood, Calif. 91606; Forrest R. Fike, Simi Valley, Calif.

[73] Assignee: Jonothon M. W. McIntyre, North Hollywood, Calif.

[21] Appl. No.: 119,668

[22] Filed: Sep. 13, 1993

[51] Int. Cl.[6] ..... B27B 21/00

[52] U.S. Cl. ..... 182/181; 182/151

[58] Field of Search ..... 182/181–186, 182/153, 224–227, 151; 248/164

[56] References Cited

U.S. PATENT DOCUMENTS

| | | | |
|---|---|---|---|
| 801,431 | 10/1905 | Adams | 182/181 |
| 1,222,020 | 4/1917 | Myers | 182/181 X |
| 1,672,502 | 6/1928 | Roth | 182/185 X |
| 2,299,823 | 10/1942 | Juculano | 182/181 |
| 3,035,660 | 5/1962 | Leon | 182/181 |
| 4,267,606 | 4/1981 | Hodson | 248/164 X |
| 4,394,005 | 7/1983 | Stewart | 182/185 X |
| 4,433,753 | 2/1984 | Watson | 182/181 X |
| 5,092,571 | 3/1992 | Stevens . | |
| 5,289,897 | 3/1994 | Wiehe, Jr. | 182/154 |

*Primary Examiner*—Alvin C. Chin-Shue

*Attorney, Agent, or Firm*—Kelly, Bauersfeld & Lowry

[57] ABSTRACT

A multi purpose worktable can be used as a table base or as a replacement for a conventional sawhorse. The worktable is assembled and dissassembled without the use of tools into individual lightweight components which are easily stored and transported. When assembled, the worktable is sturdy and durable, and includes a pair of plastic endpieces, and several cross-members in the form of wooden boards. Opposed openings receive the ends of the wooden boards, and clamps to hold the boards in the openings.

20 Claims, 2 Drawing Sheets

FIG. 1
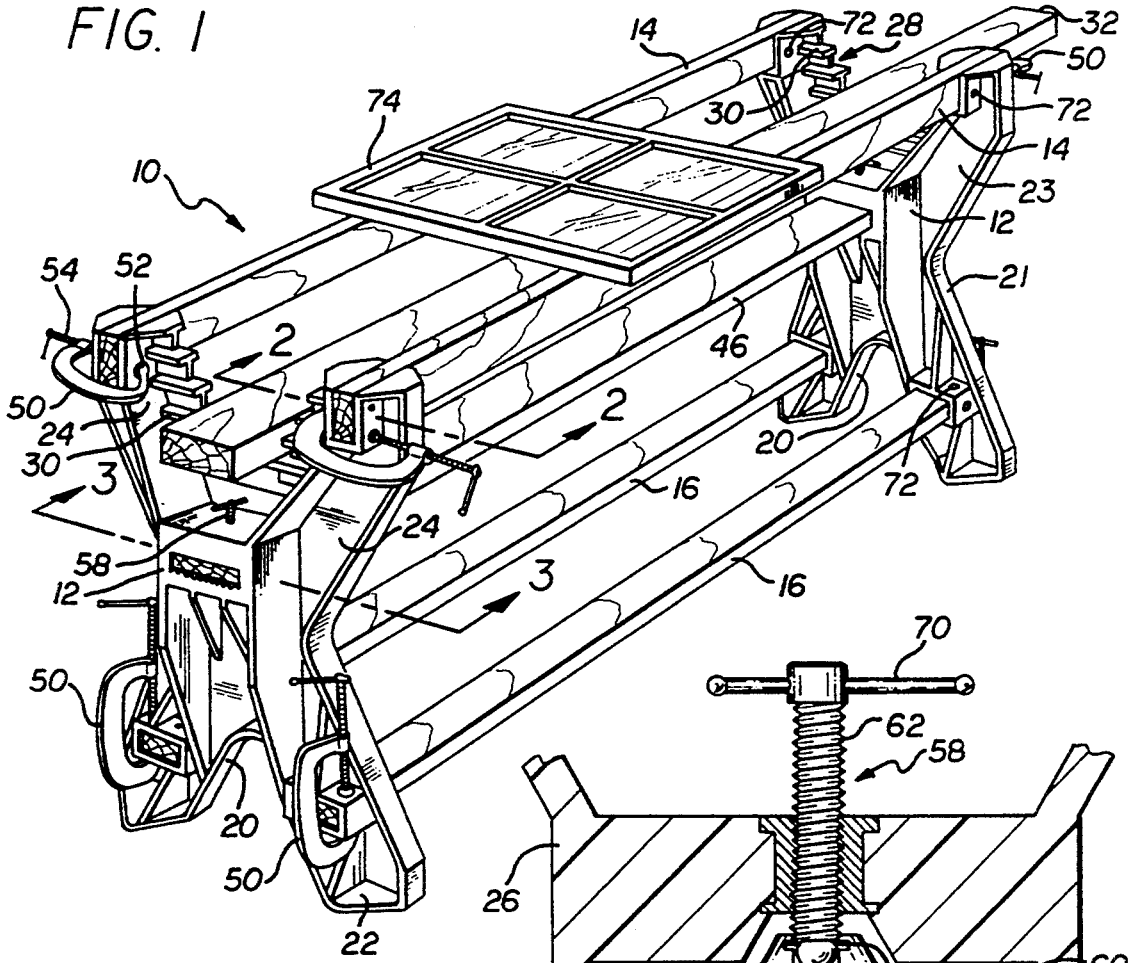
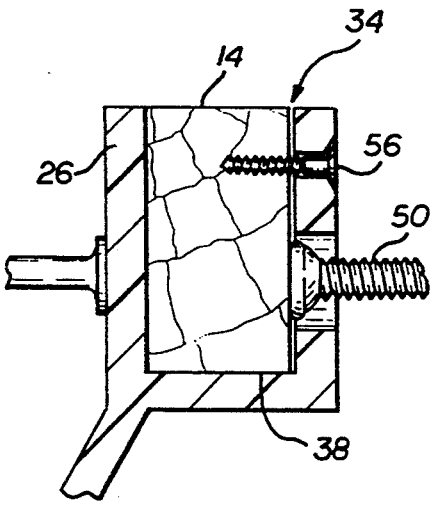
FIG. 2
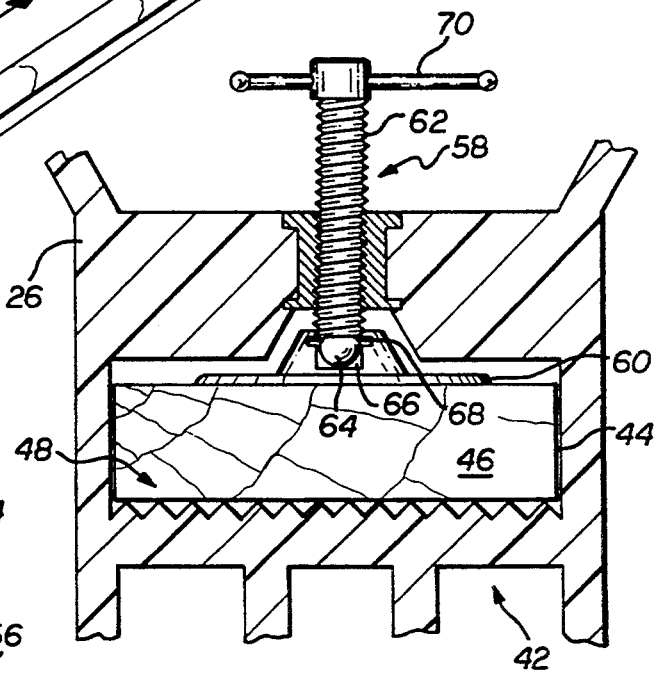
FIG. 3

MULTI-PURPOSE WORKTABLE

BACKGROUND OF THE INVENTION

This invention relates generally to supports for tables and workstands. More specifically, the present invention relates to a multi-purpose worktable.

Sawhorses are staple equipment for those in the building and repair trades and are used to support objects being worked on. For example, a sawhorse may be used to support a piece of wood being sawed. A pair of sawhorses can also be used as the base for a makeshift table. Despite their great utility, problems exist in sawhorse use, primarily because of storage and transportion problems associated therewith.

Conventional sawhorses are generally permanently constructed with two inverted V-shaped end-pieces approximately two feet tall and a horizontal cross-beam. This construction imposes certain space constraints for sawhorse storage and transport areas. These areas must be large enough to accommodate the bulky construction of the conventional sawhorse. Unfortunately, space is often at a premium in storage or in transport vehicles.

Accordingly, there has been a need for a collapsible multi-purpose worktable which can serve as a table or as a replacement for conventional sawhorses. Such a worktable is needed which can be assembled and collapsed without the use of tools. This would solve the transportation and storage problems noted above encountered with standard sawhorses. Further, a worktable is needed which is made up in part by building supplies commonly on hand. The present invention fulfills these needs and provides other related advantages.

SUMMARY OF THE INVENTION

In accordance with the invention, a multi-purpose worktable is provided which can be assembled and disassembled without the use of tools into individual components. The multi-purpose worktable comprises, generally, at least one pair of endpieces, and means for interconnecting the endpieces. A plurality of opposed openings are provided in the endpieces for receiving the ends of the interconnecting means. Anchoring means are also provided for securing the ends of the interconnecting means in the openings. When the multi-purpose worktable is dissassembled, the endpieces and the interconnecting means can be hung on a wall, stacked, etc., thus eliminating the storage and transportation problems of conventional sawhorses.

In a preferred form of the invention, the endpieces each have oppositely facing first and second sides, and a pair of divergent legs. The legs have feet to maintain the endpieces in a freestanding, upright and stable position. In one form, the endpieces are generally X-shaped having a pair of divergent arms which form a V-shape. The divergent arms define a series of 90 degree stepped surfaces forming platforms to receive, for example, a portion of a piece of wood being sawed. The oppositely facing first and second sides are mirror images of one another. In another form, the endpieces are generally A-shaped.

The interconnecting means may comprise cross-members in the form of wooden boards, such as 2×4's. The cross-members extend horizontally inwardly of the pair of endpieces and include upper and lower members. The upper and lower members are received in respective upper and lower openings, which extend through the endpieces. The upper openings are upright U-shaped channels. In one form of the invention, the upright U-shaped channel is defined by the terminal end of each arm of the generally X-shaped endpiece. In the other form of the invention, the upright U-shaped channel is defined in the top of the A-shaped endpiece.

The lower openings are rectangular apertures defined in the leg of each endpiece. The X-shaped endpieces also define a mid-section opening in the form of a horizontally-oriented rectangular bracket for receiving a mid-section cross-member. The openings are sized to fit closely around the ends of the cross-members. A reinforcing structure around each of the openings provides additional support.

The anchoring means comprises a C-clamp which secures the ends of the cross-members in the upper and lower openings. The mid-section cross-member is secured in the mid-section opening by a stationary daisy wheel clamp. Pre-drilled holes in the endpiece adjacent to the openings accommodate the C-clamps.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view of one embodiment of a collapsible, multi-purpose worktable embodying the novel features of the invention, illustrating the worktable being used to support a window and a piece of wood and having a pair of generally X-shaped endpieces;

FIG. 2 is an enlarged, fragmented partially sectional view taken generally on the line 2—2 of FIGS. 1 and 4, showing an upper cross-member anchored in an upright U-shaped channel;

FIG. 3 is an enlarged, fragmented partially sectional view taken generally on the line 3–3 of FIG. 1, illustrating a mid-section cross-member anchored in a horizontally-oriented rectangular opening by a daisy wheel clamp;

DETAILED DESCRIPTION OF THE PREFERRED EMBODIMENTS

Figure 4:
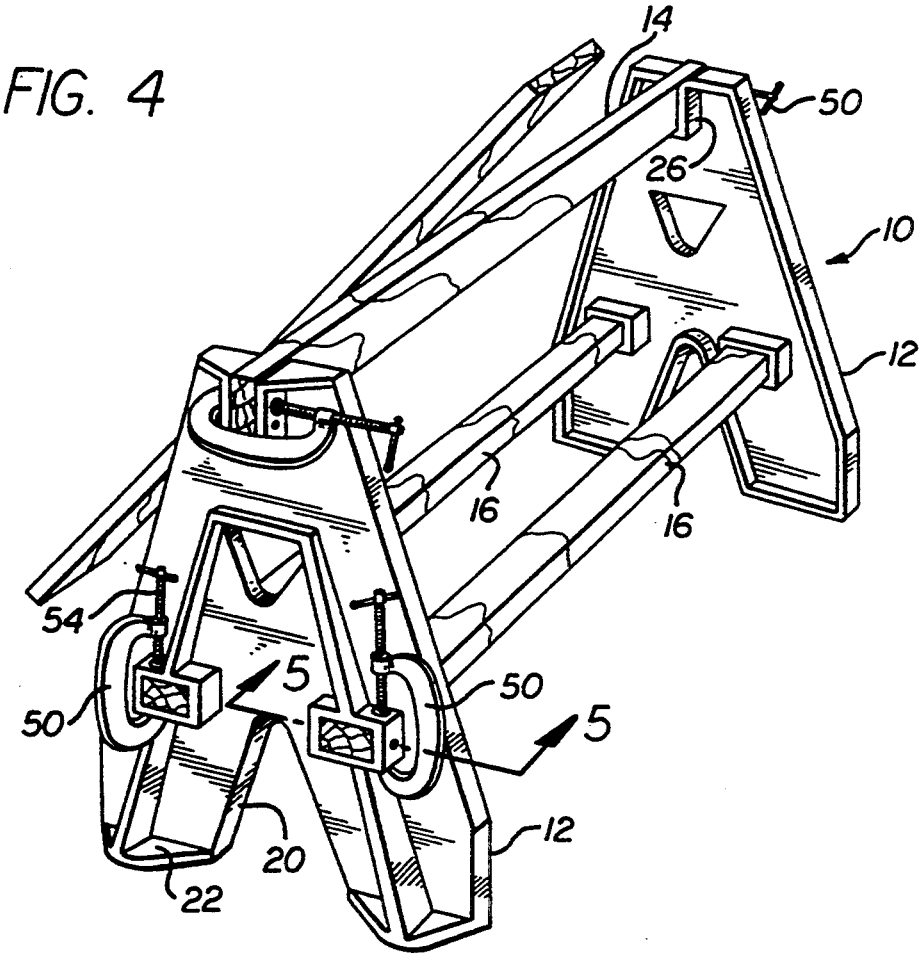
FIG. 4 is a perspective view of a second embodiment of the worktable, illustrating the worktable being used to support a piece of wood and having a pair of generally A-shaped endpieces.

As shown in the drawings for purposes of illustration, the present invention is concerned with a collapsible multi-purpose worktable, generally designated in the accompanying drawings by the reference number 10. In accordance with the present invention, the worktable comprises generally, at least one pair of endpieces 12, upper and lower cross-members 14 and 16 to interconnect the endpieces 12, a plurality of opposed openings 17 in the endpieces for receiving the ends of said cross-members, and fasteners 18 for removably securing the cross-members in said openings.

As illustrated in FIGS. 1–5, the multi-purpose worktable can be used as a table base or as a replacement for a conventional sawhorse. The multi-purpose worktable may be disassembled without the use of tools into lightweight components which are easily stored and transported. When assembled, the worktable is both sturdy and durable.

The worktable endpieces 12 each have a pair of divergent legs 20 with feet 22 to maintain the endpieces 12 in a freestanding, upright and stable position. Each endpiece has a first side 21 and an oppositely facing second side 23. The endpieces 12 are molded from a suitable plastic in a two-dimensional, two part mold with a bridge and beam structural design. Such design decreases endpiece weight and material usage while increasing endpiece structural integrity and strength. Of course, other molding techniques can be used within the confines of this invention.

In a first preferred embodiment as illustrated in FIG. 1, the endpieces 12 are generally X-shaped having a pair of divergent arms 24. The endpiece second side 23 in this form of the invention is a mirror image of the endpiece first side 21. The arms 24 form a "V" defining a series of 90 degree angled, stepped surfaces 28 forming platforms 30. The platforms 30 support a portion of, for example, a piece of wood 32. The surfaces 28 are stepped to accommodate various standard wood board dimensions, for example from a 2×4 on the lowest, narrowest platform to a 2×12 on the highest, widest platform. Intermediate platforms can accommodate intermediate-sized pieces of wood such as a 2×6, 2×8, and 2×10. The piece of wood 32 is typically placed within the "V" of the divergent arms such that its ends extend beyond the outer edge of the respective platform. Further, the piece of wood 32 simply rests on the platforms 30, and the lubricity of the platforms permit the wood to be fed across the worktable to perform, for example, cut-off work.

In an alternative embodiment, shown in FIG. 4, the endpieces 12 are generally A-shaped. Components in FIG. 4 functionally identical to those depicted in FIG. 1 are referred to by the same number.

In both embodiments the upper and lower cross-members 14 and 16 are generally boards of wood such as 2×4's. The upper and lower cross-members 14 and 16 extend laterally inwardly of the pair of endpieces 12. The cross-members are received in upper and lower openings 34 and 36 which extend through the endpieces from one side to the other. When assembled, the upper cross-members 14 extend from the upper opening 34 in one endpiece 12 to an opposed upper opening in the opposite endpiece. Similarly, the lower cross-members 16 extend horizontally from a lower opening 36 in one endpiece 12 to the opposed lower opening in the opposite endpiece. The cross-members extend through the endpieces terminating at the outside edge of the openings.

The upper openings 34, as illustrated in FIG. 2, are upright U-shaped channels 38. In the first preferred embodiment (FIG. 1) the U-shaped channels are defined by the terminal end of each arm 24 of the generally X-shaped endpiece. In the embodiment of FIG. 4, the upright U-shaped channel 38 is defined in the top of the A-shaped endpiece. The upper cross-members 14 are seated on their narrow edge in the upper openings 34. This arrangement increases the bearing weight of the upper cross-members 14.

Figure 5:
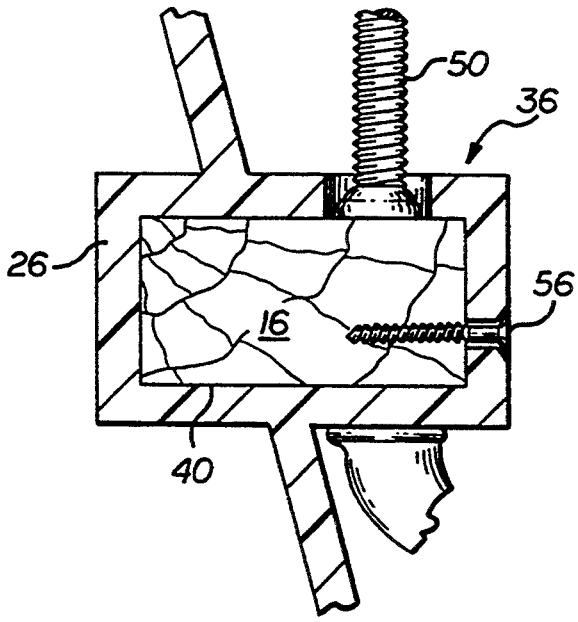
FIG. 5 is an enlarged, fragmented partially sectional view taken generally along the line 5—5 of FIGS. 1 and 4, illustrating the manner in which a lower cross-member is anchored in a horizontally-oriented rectangular lower opening in the legs of the endpieces.

The lower openings 36, as illustrated in FIG. 5, are horizontally-oriented rectangular apertures 40 defined in the legs 20 of each endpiece 12.

The endpieces 12 having a generally X-shape also define a mid-section opening 42 in the form of a bracket 44 for receiving the ends of a mid-section cross-member 46. The mid-section opening 42 is generally rectangular and horizontally-oriented, and includes a series of ridged teeth 48 on its inside lower surface.

A C-clamp 50 secures the upper and lower cross-members 14 and 16 within their respective openings. A reinforcing structure 26 around each of the openings provides additional support. The reinforcing structures 26 protrude from the first and second endpiece sides 21 and 23. The reinforcing structures 26 for the upper and lower openings 34 and 36 have a first pre-drilled hole 52 adjacent to the first side 21 of the endpiece. In the X-shaped endpieces 12 (FIG. 1), a second pre-drilled hole 72 adjacent to the second side 23 is provided. Each C-clamp 50 extends through the respective first pre-drilled hole 52. The C-clamps 50 securing the upper cross-members 14 are oriented horizontally while the C-clamps securing the lower cross-members 16 are oriented vertically, and each include a clamp adjustment bolt 54 for tightening and loosening the C-clamp.

A dry wall screw fastener 56 may also be used to secure the upper and lower cross-members in the openings, as shown.

In the first preferred embodiment (FIG. 1), a daisy wheel clamp fastener 58 is used to secure the mid-section cross-member 46 within the mid-section opening 42. The daisy wheel clamp 58 includes a 2½" pod 60 into which a bolt 62 is seated. The bolt's lower end is a ball 64 positioned within a socket 66. The ball 64 is held in the socket 66 by a snap-in lock ring 68. The bolt's upper end is an adjustment pin 70 for tightening and loosening the daisy wheel clamp 58. The daisy wheel clamp 58 is permanently affixed in the endpiece 12, and the mid-section cross-member 46 is anchored in the mid-section opening 42 by tightening the daisy wheel clamp. The clamp 58 and the ridged teeth 48 substantially reduce lateral twisting of the mid-section cross-member 46, thereby providing high strength to the worktable 10.

Since the first and second sides of each X-shaped endpiece 12 are mirror images of each other, multiple endpieces can be interconnected to form a larger worktable (not shown), without regard to identifying an endpiece as a middle endpiece, outside endpiece, etc. Two oppositely extending upper and lower cross-members are received, respectively, in the same openings 34 and 36 from opposite sides, relying on an additional C-clamp 50 and/or dry wall screw 56 if necessary. The additional C-clamp is driven through the second pre-drilled hole 72.

From the foregoing is is to be appreciated that both illustrated worktables 10 can be used like a conventional sawhorse. Additionally, the upper cross-members 14 of the worktable of FIG. 1 can support an object being worked on, for example a window 74, or act simply as a base on which a flat surface can be placed to create a table.

The lower cross-members create additional storage space in the form of an open shelving area which is both convenient and accessible. Thus, the assembled worktable 10 can serve multiple purposes, a feature desirable in a space-limited environment.

Although two particular embodiments of the invention have been described in detail for purposes of illustration, various modifications of each may be made without departing from the spirit and scope of the invention. Accordingly, the invention is not to be limited, except as by the appended claims.

We claim:

1. A multi-purpose worktable, comprising:

two endpieces, wherein said endpieces each have a pair of footed divergent legs for maintaining the endpieces in an upright and stable position, and a pair of upstanding divergent arms;

means for interconnecting said endpieces, wherein said interconnecting means are horizontal an upper U-shaped channel, lower and mid-section cross-members;

a plurality of opposed openings in said endpieces for receiving the ends of said interconnecting means, wherein the opposed openings comprise upper, lower and mid-section openings, wherein said upper openings receive the ends of said upper cross-members, said lower openings receive the ends of said lower cross-members, and said mid-section openings receive the ends of said mid-section cross-member; and anchoring means for securing said ends of said interconnecting means in said openings.

2. The multi-purpose worktable of claim 1 wherein said anchoring means include C-clamps.

3. A multi-purpose worktable, comprising:

a pair of generally X-shaped endpieces each having a pair of footed divergent legs, and a pair of upstanding divergent arms;

a plurality of horizontal cross-members for interconnecting said endpieces;

a plurality of opposed upper, lower and mid-section openings in said endpieces for receiving ends of said cross-members said upper openings comprise an upright U-shaped channel; and anchoring means for securing the cross-member ends in said opposed openings.

4. The multi-purpose worktable of claim 3, wherein said arms form a V defining a series of stepped surfaces forming upwardly facing platforms.

5. The multi-purpose worktable of claim 4, wherein the horizontal cross-members include upper cross-members the ends of which are received in the upper openings, and wherein the upper openings are upright U-shaped channels defined in a terminal end of each arm.

6. The multi-purpose worktable of claim 4, wherein the horizontal cross-members include a pair of lower cross-members the ends of which are received in the lower openings, and wherein the lower openings are horizontally-oriented rectangular openings defined in each leg.

7. The multi-purpose worktable of claim 4, wherein the cross-member comprises a mid-section cross-member the ends of which are received in the mid-section opening, and wherein a daisy wheel clamp anchors the mid-section cross-member in said opposed mid-section openings.

8. The multi-purpose worktable of claim 7, wherein an inside lower surface of the mid-section openings includes ridged teeth for gripping the mid-section cross-member when the daisy wheel clamp is tightened.

9. The multi-purpose worktable of claim 3, wherein each endpiece has mirror-image, oppositely facing, first and second sides and wherein a reinforcing structure around each opening protrudes from the oppositely facing first and second sides of the endpiece.

10. The multi-purpose worktable of claim 9, wherein the anchoring means comprises C-clamp anchors inserted through pre-drilled holes in the reinforcing structure adjacent to the upper and lower openings.

11. A multi-purpose worktable, comprising:

a pair of endpieces each having a pair of divergent legs and a pair of upstanding divergent arms;

a plurality of horizontal cross-members for interconnecting said endpieces; and a plurality of opposed openings in said endpieces for receiving ends of said cross-members;

wherein the horizontal cross-members include upper cross-members the ends of which are received in upper opposed openings in the endpieces, and wherein the upper openings comprise upright U-shaped channels in a terminal end of each arm.

12. The multi-purpose worktable of claim 11, wherein said arms include stepped surfaces forming upwardly facing platforms.

13. The multi-purpose worktable of claim 11, wherein the horizontal cross-members include lower cross-members the ends of which are received in lower opposed openings in the endpieces, and wherein the lower openings comprise horizontally-oriented rectangular openings in each leg.

14. The multi-purpose worktable of claim 11, wherein the horizontal cross-members include a mid-section cross-member the ends of which are received in mid-section opposed openings in the endpieces.

15. The multi-purpose worktable of claim 14, including anchoring means for securing the mid-section cross-member ends in said opposed mid-section openings.

16. The multi-purpose worktable of claim 15, wherein the anchoring means includes a daisy wheel clamp, and wherein said opposed mid-section openings include ridged teeth for gripping the mid-section cross-member when the daisy wheel clamp is tightened.

17. The multi-purpose worktable of claim 12, wherein each endpiece has mirror-image, oppositely facing, first and second sides.

18. The multi-purpose worktable of claim 17, including a reinforcing structure around each of said plurality of opposed openings which protrudes from the oppositely facing first and second sides of the respective end piece.

19. The multi-purpose worktable of claim 12, including anchoring means for securing the cross-member ends in said opposed openings.

20. The multi-purpose worktable of claim 19, wherein the anchoring means comprises C-clamps inserted through apertures in the endpieces adjacent to the openings.

* * * * *